US008567298B2

(12) United States Patent
Pearson

(10) Patent No.: US 8,567,298 B2
(45) **Date of Patent: *Oct. 29, 2013**

(54) COST-EFFECTIVE HIGH-VOLUME METHOD TO PRODUCE METAL CUBES WITH ROUNDED EDGES

(71) Applicant: Ervin Industries, Inc., Ann Arbor, MI (US)

(72) Inventor: James Trent Pearson, Saline, MI (US)

(73) Assignee: Ervin Industries, Inc., Ann Arbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/770,098

(22) Filed: Feb. 19, 2013

(65) Prior Publication Data

US 2013/0160278 A1 Jun. 27, 2013

Related U.S. Application Data

(63) Continuation of application No. 13/252,672, filed on Oct. 4, 2011.

(60) Provisional application No. 61/443,473, filed on Feb. 16, 2011.

(51) Int. Cl.
*F42B 7/04* (2006.01)

(52) U.S. Cl.
USPC ..... 86/57; 102/448; 29/412

(58) Field of Classification Search
USPC ..... 86/57, 54; 102/459, 448, 501, 460, 436, 102/506; 75/342; 29/33 F, 564, 412, 417
See application file for complete search history.

(56) References Cited

U.S. PATENT DOCUMENTS

| | | | | |
|---|---|---|---|---|
| 1,583,559 | A | 5/1926 | Kenneweg | |
| 1,598,814 | A | 9/1926 | Galvin | |
| 1,601,252 | A | 9/1926 | Lines | |
| 2,689,360 | A * | 9/1954 | Ware | 470/89 |
| 2,703,512 | A | 3/1955 | Brookes et al. | |
| 2,758,360 | A * | 8/1956 | Shetler | 86/57 |
| 2,767,656 | A | 10/1956 | Zeamer | |
| 2,782,487 | A * | 2/1957 | Properzi | 86/57 |

(Continued)

FOREIGN PATENT DOCUMENTS

| | | |
|---|---|---|
| CN | 101780507 | 7/2010 |
| DE | 9416568 U1 | 5/1995 |
| DE | 10151585 C1 | 6/2003 |
| WO | 9510753 A2 | 4/1995 |

OTHER PUBLICATIONS

International Search Report and Written Opinion for PCT/US2012/040112 mailed Sep. 26, 2012.

(Continued)

*Primary Examiner* — Michael Carone
*Assistant Examiner* — Reginald Tillman, Jr.
(74) *Attorney, Agent, or Firm* — Sutherland Asbill & Brennan LLP

(57) ABSTRACT

This disclosure generally relates to high-volume and cost-effective methods for producing non-spherical metal particles, particularly methods for producing metal cubes having rounded edges. The metal cubes having rounded edges are useful as ballistic shot in shotshell loads for hunting, where the particle shape imparted by the disclosed process packs to a higher density than spherical shot in the same volume.

24 Claims, 3 Drawing Sheets

(56) References Cited

U.S. PATENT DOCUMENTS

| | | | | |
|---|---|---|---|---|
| 3,204,320 | A * | 9/1965 | Eckstein et al. | 29/899 |
| 3,641,795 | A | 2/1972 | Lester et al. | |
| 3,952,659 | A | 4/1976 | Sistino | |
| 4,091,575 | A | 5/1978 | Rampe | |
| 4,173,930 | A | 11/1979 | Faires, Jr. | |
| 4,650,380 | A | 3/1987 | Lipowski | |
| 4,901,575 | A | 2/1990 | Bohannan | |
| 4,946,359 | A | 8/1990 | Christen | |
| 4,996,924 | A | 3/1991 | McClain | |
| 5,158,629 | A | 10/1992 | Zobbi | |
| 5,171,934 | A | 12/1992 | Moore | |
| 5,200,573 | A | 4/1993 | Blood | |
| 5,225,628 | A | 7/1993 | Heiny | |
| 5,761,779 | A * | 6/1998 | Maruyama et al. | 29/899 |
| 5,890,975 | A | 4/1999 | Stiefel | |
| 5,927,131 | A | 7/1999 | Kiuchi et al. | |
| 6,018,854 | A * | 2/2000 | Miyasaka | 29/899 |
| 6,258,316 | B1 | 7/2001 | Buenemann | |
| 6,394,881 | B1 | 5/2002 | Watanabe | |
| 6,439,126 | B1 | 8/2002 | Kennedy et al. | |
| 6,749,662 | B2 * | 6/2004 | Bueneman et al. | 75/338 |
| 7,127,996 | B2 | 10/2006 | Muth | |
| 7,194,960 | B2 | 3/2007 | Vasel et al. | |
| 7,273,409 | B2 | 9/2007 | Hoffman | |
| 7,350,465 | B2 | 4/2008 | Keegstra et al. | |
| 7,765,933 | B2 | 8/2010 | Poore et al. | |
| 2003/0039764 | A1 | 2/2003 | Burnes | |
| 2008/0286469 | A1 * | 11/2008 | Baumbach et al. | 427/292 |
| 2010/0233510 | A1 | 9/2010 | Sroka | |
| 2012/0234199 | A1 * | 9/2012 | Meyer | 102/459 |

OTHER PUBLICATIONS

Micro Machine Tools website—http://www.micromachinetools.com/steel-ball-processing-machines.html (2 pages).

Rosier Consumables Catalog (28 pages).

Third-Party Submission under 37 CFR 1.290 filed by Bryan Wheelock on Feb. 19, 2013 (8 pages).

Third-Party Submitter's Alleged Explanation of Relevance (19 pages).

* cited by examiner

COST-EFFECTIVE HIGH-VOLUME METHOD TO PRODUCE METAL CUBES WITH ROUNDED EDGES

CROSS REFERENCE TO RELATED APPLICATIONS

This application is a continuation of U.S. patent application Ser. No. 13/252,672, filed Oct. 4, 2011, which claims the benefit of U.S. Provisional Patent Application No. 61/443,473, filed Feb. 16, 2011, each disclosure of which is incorporated by reference herein in its entirety.

FIELD OF THE INVENTION

The disclosed matter generally relates to methods for producing polyhedral metal particles, including high-volume methods for producing cubic particles of metals that can be mechanically shaped.

BACKGROUND OF THE INVENTION

Spherical metal particles or pellets, generally referred to as shot, find applications across a number of industries as abrasive media and are widely used as projectiles in shotshells for sporting purposes. Industrial shot is useful as an abrasive for etching a textured surface onto metal to enhance bonding with various coatings, or as a blast cleaning medium to remove surface contamination from metal products. Metal shot is useful in peening processes to impart compressive strength to torque-bearing metal parts such as jet engine turbine blades. For hunting and sporting use, shot pellets for shotshells can assume a range of sizes, compositions, and densities as the particular application dictates.

Conventional methods for producing of metal spheres include metering the molten metal into uniform portions that are dropped into water and cooled, while surface tension brings the molten sample into spherical form. Other methods impinge a jet of water or other fluid onto a stream of molten metal, which atomizes the molten metal to form metal spheres. While such methods may be suitable for producing high volumes of particles of nearly uniform size, they are not amenable to producing anything other than spherical or near-spherical particles.

Recently, non-spherical metal particles or shot have found utility in particular shotshell applications. For example, shot pellets having a smoothed hexahedral shape, that is, a cube with smooth or rounded edges and corners, show promise for improved hunting loads. The cubic structure of the pellets is more space-filling and packs more efficiently than spherical shot, thereby providing a greater mass of shot in the same unit volume as compared to spherical shot. This feature may be particularly useful for hunting loads where ballistic steel and various high density alloys are supplanting lead shot, as lead becomes more strictly regulated. One example of flattened spherical shot is illustrated in U.S. Pat. No. 3,952,659.

Therefore, methods are needed that can produce non-spherical metal particles, including metal cubes with rounded edges, efficiently and in high volume. What are also needed are methods that can provide non-spherical metal particles, which are amenable to mass production of metal cubes and are relatively economical.

SUMMARY OF THE INVENTION

According to one aspect of this disclosure, there is provided a method of making non-spherical metal shot, specifically, polyhedral shot such as cubic shot. This disclosure also describes a cost-effective process for producing metal cubes (hexahedra) with rounded edges. The resulting metal cubes with rounded edges have good bulk flow properties and pack efficiently, enabling their use as advanced projectiles for shotshell ammunition. One feature of the disclosed method is its scalability and adaptability for mass production of the desired metal cubes, thereby imparting economic viability to the process. A wide variety of sizes and finishes and degree of rounding on the edges of the metal cubes can be achieved according to this disclosure, making this technology versatile as well as economical. While there are no theoretical restrictions on the size of the metal cube that can prepared as disclosed, this process works very well from a practical perspective with approximately 5-6 mm or smaller shot, that is, 5-6 mm square and smaller.

This disclosure also describes, among other things, unique combinations of metal processing methods. For example, in one aspect, there is disclosed the drawing or rolling and chopping of square-profiled wire, grinding of the resulting particle that leads to partial mechanical rounding, followed by high-energy finishing. While the disclosed methods are exemplified primarily with low-carbon steel, they can be adapted to any material that can be mechanically shaped, including any number of metals, composite, alloys, and the like.

Thus, in accordance with one aspect, there is provided a process for making non-spherical shot, including symmetric non-spherical shot, the method comprising:

a. providing a metal wire having a non-circular cross section;
b. serially cutting the metal wire into rough shot;
c. applying a radius to the rough shot to provide radiused shot with edges having a selected radius of curvature; and
d. finishing the radiused shot by energetically contacting the radiused shot with a finishing medium to provide finished non-spherical shot.

The step of applying a radius to the rough shot can be carried out, for example, by grinding or by a type of abrasive blasting. A number of additional and optional steps may be included in the subject process, if desired. For example, the finishing step can further energetically contact the radiused shot and the finishing medium with a cleaning compound. The finished non-spherical shot can be optionally stress annealed to reduce or eliminate hardening introduced from the mechanical shaping steps, if so desired. Optionally, the finished non-spherical shot or the annealed finished non-spherical shot can be polishing.

In another aspect, this disclosure provides a method or process for making non-spherical shot, including symmetric non-spherical shot, the method or process comprising:

a. extruding or drawing a metal wire through a die having a non-circular cross section to provide a metal wire having a non-circular cross section;
b. serially cutting the metal wire into rough shot;
c. grinding the rough shot to provide radiused shot with edges having a selected radius of curvature;
d. finishing the radiused shot by energetically contacting the radiused shot with a finishing medium and optionally a cleaning compound to provide finished non-spherical shot;
e. optionally, annealing the finished non-spherical shot; and
f. optionally, polishing the annealed finished non-spherical shot.

This process is well-suited for the production of metal cubes with rounded edges, wherein the process can comprise:

a. providing a metal wire having a square cross section or a square cross section with rounded edges;
b. serially cutting the metal wire into rough cubes;
c. grinding the rough cubes to provide radiused cubes with edges having a selected radius of curvature; and
d. finishing the radiused cubes by energetically contacting the radiused cubes with a finishing medium to provide finished metal cubes with rounded edges.

These and other aspects and embodiments of the disclosed methods and articles of manufacture are described more fully in the detailed description and further disclosure provided herein.

BRIEF DESCRIPTION OF THE FIGURES

The accompanying figures, which are incorporated in and constitute a part of this specification, illustrate several aspects described below.

DETAILED DESCRIPTION OF THE INVENTION

Figure 1:
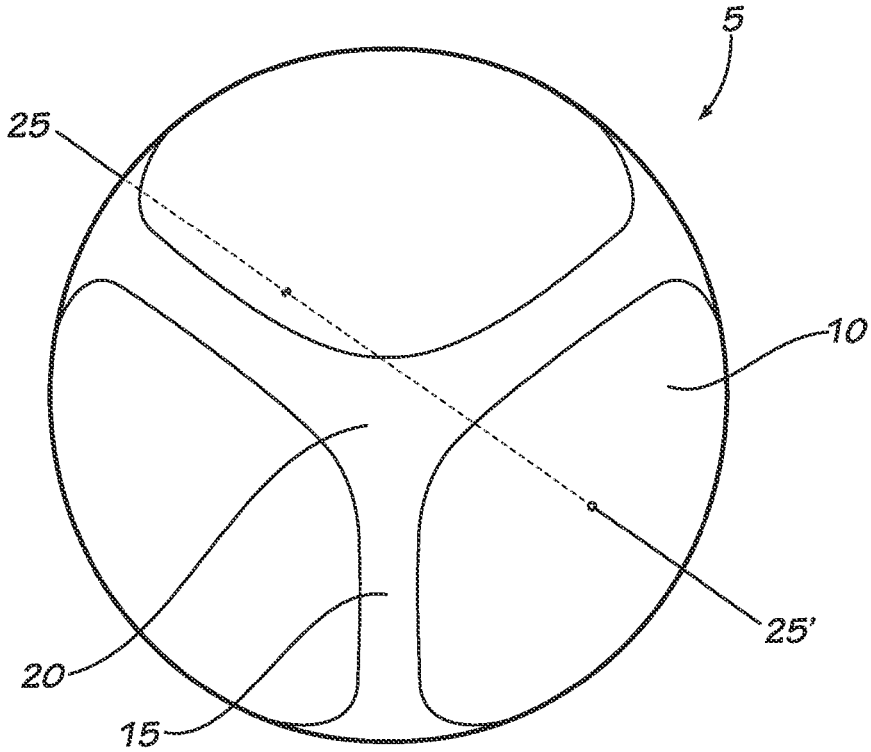
FIG. 1 is a perspective illustration of the general shape of a metal cube with rounded-edges that can be mass produced according to this disclosure.

The subject matter of this disclosure may be understood more readily by reference to the following detailed description of specific aspects thereof. It is understood that the terminology used herein is for the purpose of describing particular aspects of the disclosed subject matter and is not intended to be limiting.

Among other things, this disclosure provides a process for making polyhedral metal shot, particularly, metal cubes (hexahedra) with rounded edges, in a cost-effective and high volume manner. The use of more space-filling shot such as metal cubes as projectiles is advantageous at least because such a geometry provides a greater mass of shot in the same unit volume as compared to spherical shot. The use of rounded edges to the metal cubes (hexahedra) is advantageous at least because the rounding allows the metal cubes to flow efficiently and display good ballistic properties. These features are highly useful with steel shot projectiles for shotshells, where increasing the total projectile weight within the same shotshell volume is desirable and where projectile material densities are typically less than that of lead. The advantageous features of metal cubes with rounded edges are applicable to various alloys of tungsten, iron, bismuth and the like, which are becoming increasingly common, yet which often do not attain the same density of lead.

General Procedure

In one exemplary aspect, for example, the shot of this disclosure can be made using low-carbon steel, wherein the low-carbon steel can be drawn or extruded into wire with a square cross-section or a square cross section with rounded edges. For example, the subject shot can be made using low-carbon steel, wherein the low-carbon steel can be drawn or extruded into wire with a square profile or cross-section. The drawing die can impart the square shape or any non-circular cross section to the wire. Moreover, the drawing die also can impart rounded edges to the wire, for example, the drawing die can achieve the general, square shape to the wire and also include rounded edges having the desired radius. This feature provides what is essentially a processing advantage towards the desired final geometry and notably improves the efficiency of the subsequent grinding process to impart rounded edges to the remaining, angular (non-rounded) edges that arise from chopping or cutting the wire.

The drawn or extruded wire can then be precisely and serially chopped into cubes of rough shot, that are then ground or "radiused". This radiusing step can be carried out using what is termed a Steel Ball Processing Machine by its developers, or by propelling the rough shot against a hardened steel plate, which is termed here as abrasive blasting or "modified" abrasive blasting. These methods are capable of rounding the remaining sharp edges of the cubes that were not previously rounded as drawn, to impart the desired radius of curvature and generate what is termed radiused shot. The Steel Ball Processing Machine grinding process and abrasive blasting process typically leave a burr or flash on the radiused shot, which can subsequently be removed by employing a centrifugal disc finishing (CDF) process. To achieve the desired finished shot, the CDF process is carried out using a tailored finishing media as disclosed herein, to provide the finished and deburred metal cubes with rounded edges. Finally, if desired, the resulting metal cubes can be stress annealed to reduce or eliminate any hardening introduced by the mechanical shaping operations. An optional polishing step can also be undertaken to impart a fine polish to the shot surfaces.

While removal of any burr or flash from the radiused shot can be accomplished efficiently using a centrifugal disc finishing (CDF) process, other methods for deburring the radiused shot are also useful, including but not limited to, relatively lower energy finishing processes as compared to CDF. For example, vibratory bowl finishing, high energy centrifugal barrel finishing, and similar finishing methods, typically using ceramic finishing media as disclosed herein, can also provide the desired finished shot. In these methods, specific operational parameters such as finisher speed and time of finishing can be ascertained and adjusted as understood by the skilled artisan.

Structural Features of Metal Cubes with Rounded Edges

The general structural features of the non-spherical shot that the subject process provides are illustrated the perspective view of FIG. 1 of the general shape of a metal cube 5 with rounded-edges that can be mass produced according to this disclosure. Metal cube 5 is the general structure of the finished shot, after it has been radiused and finished to remove any burrs or flash. Metal cube 5 comprises flat faces 10, rounded edges 15, and rounded corners 20, having approximately the same radius of curvature as the rounded edge 15. The 25-25' line illustrates a body-centered line through the midpoint of the metal cube 5, which transverses the midpoint of opposing and parallel flat faces 10, and which constitutes a reference line in further illustrations and descriptions.

Figure 2:
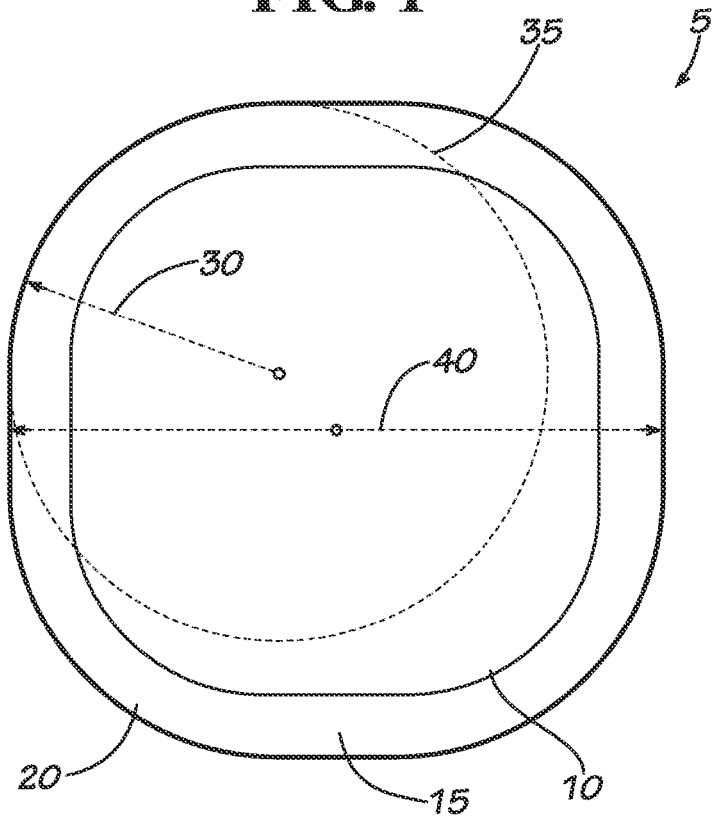
FIG. 2 is an end-on drawing of a metal cube with rounded-edges according to this disclosure, illustrating the approximately square cross section and the radius of curvature of the rounded edges of the metal cube.

FIG. 2 is an end-on drawing of a metal cube 5, viewed through one face along the 25-25' line, and also illustrating the flat face 10, rounded edge 15, and rounded corner 20. The FIG. 2 illustration demonstrates the radius of curvature 30 of the finished metal cube 5. The radius of curvature 30 circumscribes circle 35, which occupies a plane perpendicular to the 25-25' line, midway between the opposing and parallel flat faces 10, and which is illustrated in FIG. 2 as viewed along the 25-25' line. FIG. 2 also illustrates the face-to-face or "square profile" diameter, 40, which is measured from the midpoint of opposing and parallel flat faces 10, and which can be referred to simply as the diameter of the shot. Thus, the square profile diameter 40 of FIG. 2 can be measured along the body-centered line 25-25', shown in FIG. 1, or either body-centered line perpendicular to the 25-25' line as shown in FIG. 2.

The radius of curvature 30 of the metal cube shot 5, FIG. 2, is a feature that affects the performance of the shot, such as the ease with which the metal cubes flow for industrial handling and the nature of their ballistic properties. The radius of curvature 30 can be adjusted readily to achieve the desired radius using the methods of this disclosure. In one aspect, the selected radius of curvature 30 is incorporated into the die or drawing plate through which the metal wire is drawn or extruded. Conveying the selected radius of curvature 30 to the edges of the drawn wire benefits the production process by pre-forming this radius to four of the six edges of the rough shot. As a result, the subsequent grinding or other "radiusing" step to impart rounding to the remaining edges is more facile and efficient, more readily controlled, and more consistently applied such all six edges of the metal cube 5 are substantially identical.

There is no limit in theory to the size of the metal cube that can prepared according to this disclosure. The process of preparing ballistic shot can be effected to obtain metal cubes or polyhedra that have square profile diameters 40 (FIG. 2) similar to conventional spherical birdshot or buckshot. For example, while this process can be used to prepare metal cubes with a square diameter profile of about 10 mm or more, a size that corresponds to the largest of the conventional buckshot diameters, the process is illustrated in this disclosure for metal cubes that correspond to the larger birdshot diameters as would be found in commercial waterfowl loads. Thus, this process is useful for making metal cubes having a square diameter profiles similar to round shot as follows: about 7 mm, roughly corresponding to the diameter of No. 2 buckshot; about 6 mm, roughly corresponding to the diameter of No. 4 buckshot, about 5 mm, roughly corresponding to the diameter of T or BBB birdshot; about 4 mm, roughly corresponding to the diameter of No. 1 or No. 2 birdshot; about 3 mm, roughly corresponding to the diameter of No. 5 birdshot; about 2 mm, roughly corresponding to the diameter of No. 9 birdshot; and any sizes of shot that fall between these recited sizes. Table 1 reproduces the American Standard Shot sizes, and metal cubes or polyhedra that have diameters similar to any of these conventional spherical birdshot or buckshot sizes can be prepared according to this disclosure.

In accordance with a further aspect, the process of preparing ballistic shot can be effected to obtain metal cubes or polyhedra that have a weight that is comparable to conventional spherical birdshot or buckshot. For example, based on a density of SAE 1006 carbon steel of about 7.872 g/cm$^3$, spherical shot having a 4.57 mm diameter corresponds to No. BB birdshot, but the same weight of SAE 1006 steel can be obtained in a metal cube with no rounding of the edges having a square profile (face-to-face) diameter of about 3.68 mm. That is, a 4.57 mm-diameter sphere has the same mass of material as a 3.68 mm cube. When rounded edges are introduced to the cube, which effectively removes metal mass, it is apparent that the cube with rounded edges will have a square profile diameter greater than 3.68 mm, depending on the desired radius of curvature, in order to constitute the same mass as a 4.57 mm-diameter sphere of the same material.

TABLE 1

American Standard Shot Sizes

| Birdshot Sizes | | Buckshot Sizes | |
|---|---|---|---|
| Size | Diameter mm (inch) | Size | Diameter mm (inch) |
| FF | 5.84 mm (.230") | 000 or LG | 9.1 mm (.36") |
| F | 5.59 mm (.220") | 00 | 8.4 mm (.33") |
| TT | 5.33 mm (.210") | 0 or SG | 8.1 mm (.32") |
| T | 5.08 mm (.200") | SSG | 7.9 mm (.31") |
| BBB | 4.83 mm (.190") | 1 | 7.6 mm (.30") |
| BB | 4.57 mm (.180") | 2 | 6.9 mm (.27") |
| B | 4.32 mm (.170") | 3 | 6.4 mm (.25") |
| 1 | 4.06 mm (.160") | 4 | 6.1 mm (.24") |
| 2 | 3.81 mm (.150") | | |
| 3 | 3.56 mm (.140") | | |
| 4 | 3.30 mm (.130") | | |
| 5 | 3.05 mm (.120") | | |
| 6 | 2.79 mm (.110") | | |
| 7 | 2.41 mm (.100") | | |
| 8 | 2.29 mm (.090") | | |
| 9 | 2.03 mm (.080") | | |

According to one aspect, the disclosure encompasses a method of making non-spherical, polygonal shot in which the metal wire and/or the finished metal cubes can have a 1 mm to 8 mm square profile diameter. In another aspect, the metal wire and/or the finished metal cubes can have a 1.2 mm to 7 mm square profile diameter; a 1.3 mm to 6 mm square profile diameter; a 1.5 mm to 5 mm square profile diameter; alternatively, a 2 mm to 4.5 mm square profile diameter; alternatively, a 2.5 mm to 4 mm square profile diameter; or alternatively, a 3 mm to 3.5 mm square profile diameter. In still a further aspect, the metal wire and/or the finished metal cubes can have a square profile diameter of about 1 mm, 1.1 mm, 1.2 mm, 1.3 mm, 1.4 mm, 1.5 mm, 1.6 mm, 1.7 mm, 1.8 mm, 1.9 mm, 2 mm, 2.1 mm, 2.2 mm, 2.3 mm, 2.4 mm, 2.5 mm, 2.6 mm, 2.7 mm, 2.8 mm, 2.9 mm, 3 mm, 3.1 mm, 3.2 mm. 3.3 mm, 3.4 mm, 3.5 mm, 3.6 mm, 3.7 mm, 3.8 mm, 3.9 mm, 4 mm, 4.1 mm, 4.2 mm, 4.3 mm, 4.4 mm, 4.5 mm, 4.6 mm, 4.7 mm, 4.8 mm, 4.9 mm, 5 mm, 5.1 mm, 5.2 mm, 5.3 mm, 5.4 mm, 5.5 mm, 5.6 mm, 5.7 mm, 5.8 mm, 5.9 mm, 6 mm, 6.1 mm, 6.2 mm, 6.3 mm, 6.4 mm, 6.5 mm, 6.6 mm, 6.7 mm, 6.8 mm, 6.9 mm, 7 mm, 7.1 mm, 7.2 mm, 7.3 mm, 7.4 mm, 7.5 mm, 7.6 mm, 7.7 mm, 7.8 mm, 7.9 mm, or 8 mm, including any ranges between these numbers.

The combination of square profile diameter and radius of curvature are independently adjustable in the disclosed process. Thus, a further aspect provides that the metal wire and/or the finished metal cubes can have a 2.5 mm to 4 mm square profile diameter and a 0.7 to 1.5 mm radius of curvature. Still further, the metal wire and/or the finished metal cubes can have a 2.8 mm to 3.8 mm square profile diameter and a 0.9 to 1.4 mm radius of curvature. According to still another aspect, the metal wire and/or the finished metal cubes can have a radius of curvature (x)-to-metal wire square profile diameter (y) ratio x:y from 1:1 to 1:5; alternatively, from 1:1.5 to 1:4.5; alternatively, from 1:2 to 1:4; alternatively, from 1:2.5 to 1:3.5; or alternatively, from 1:2.8 to 1:3.2. The metal wire and/or the finished metal cubes also can have a radius of curvature (x)-to-metal wire square profile diameter (y) ratio x:y of about 1:1, about 1:1.1, about 1:1.2, about 1:1.3, about 1:1.4, about 1:1.5, about 1:1.6, about 1:1.7, about 1:1.8, about 1:1.9, about 1:2, about 1:2.1, about 1:2.2, about 1:2.3, about 1:2.4, about 1:2.5, about 1:2.6, about 1:2.7, about 1:2.8, about 1:2.9, about 1:3, about 1:3.1, about 1:3.2, about 1:3.3, about 1:3.4, about 1:3.5, about 1:3.6, about 1:3.7, about 1:3.8, about 1:3.9, about 1:4, about 1:4.1, about 1:4.2, about 1:4.3, about 1:4.4, about 1:4.5, about 1:4.6, about 1:4.7, about 1:4.8, about 1:4.9, or about 1:5.

Process Steps and Parameters for Making Metal Cubes with Rounded Edges

Figure 3:
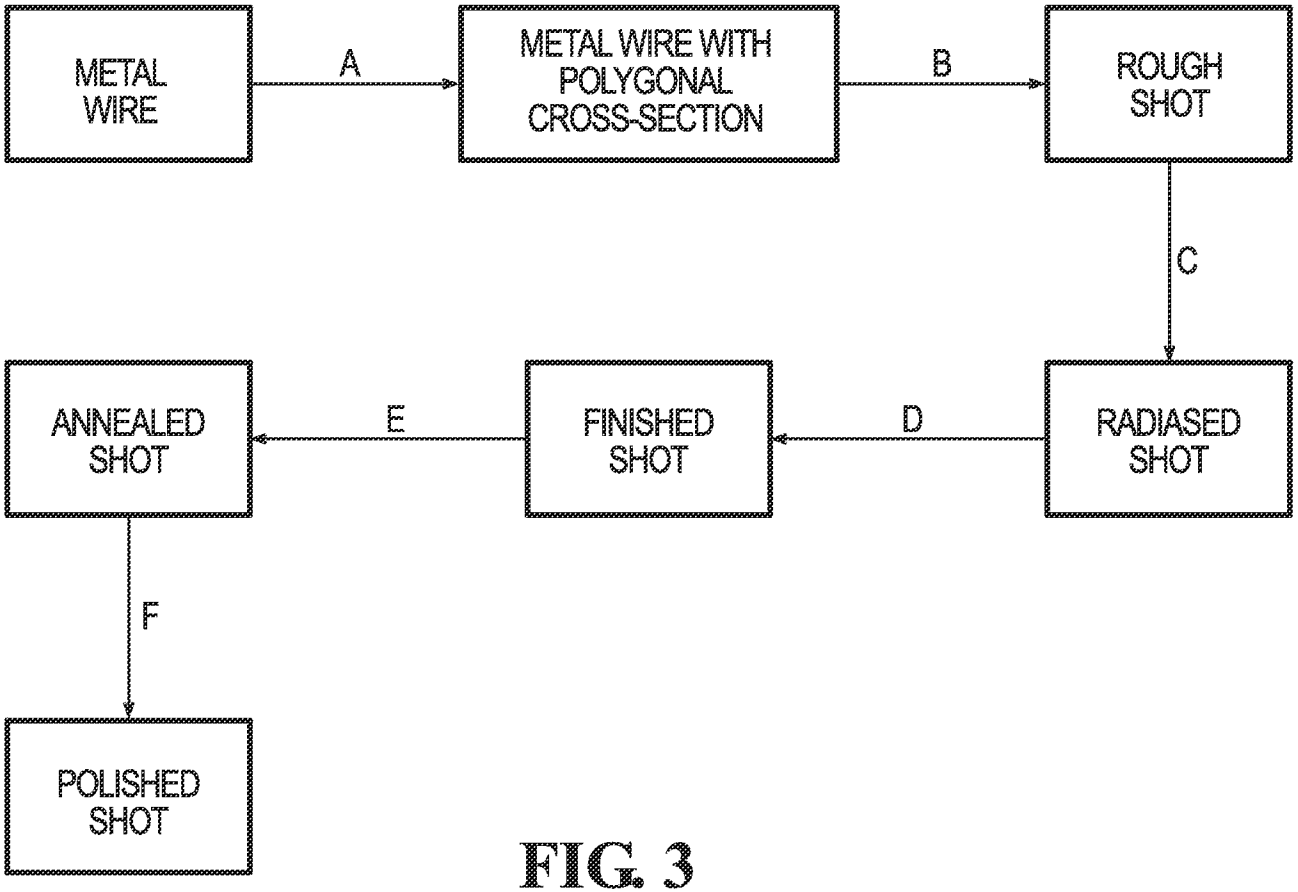
FIG. 3 is a process schematic illustrating various aspects of the disclosed method and showing the correlation of process steps.

FIG. 3 is a process schematic illustrating various aspects of the disclosed method and correlating the process steps to the articles produced therefrom. Thus, FIG. 3 demonstrates extruding or drawing a metal wire through at least one drawing die having a non-circular cross section (step A), which provides a metal wire having a non-circular cross section. This wire is then serially cut (Step B) into rough shot, which is subsequently ground (Step C) to provide radiused shot with edges having a selected radius of curvature. The radiused shot is then finished and optionally cleaned (Step D) by energetically contacting the radiused shot with a finishing medium to provide the product. Finished and optionally cleaned shot additionally can be annealing (Step E) if desired, and further optionally polished (Step F) to provide a more finished non-spherical shot.

The Examples illustrate the process for making metal cubes with rounded edges; however, the disclosed process is not limited to generating metal cubes because a variety of polyhedral shapes are capable of being made using the present method. Each of the various process steps is discussed.

a. Serially Cutting the Wire into Rough Shot. The step of sequentially or "serially" cutting the drawn metal wire produces what may be termed "rough" shot. As the metal wire is drawn into the selected profile, the wire can be cut or chopped in a sequential or serial fashion using standard equipment, such as a rotating head shearer. When preparing steel shot by chopping steel wire, for example, the a rotating head shearer with carbide blocks is typically used. The chopping or cutting can be executed on metal wire drawn into any desired profile. Thus, the disclosure encompasses a method of making non-spherical, polygonal shot, which includes cubic shot.

One feature of the present method is its capability of providing a regular polyhedron, namely a cube. In cube fabrication, the cut to the wire is made in a serial manner at repeating lengths along the wire that correspond to the face-to-face cross-section measurement or "square diameter profile" of the wire. If the metal is drawn into a profile or cross section that is not square, for example, a triangular, non-square rectangle, pentagon, and the like, then the cutting process provides a polyhedron, but not a regular polyhedron.

Figure 4:
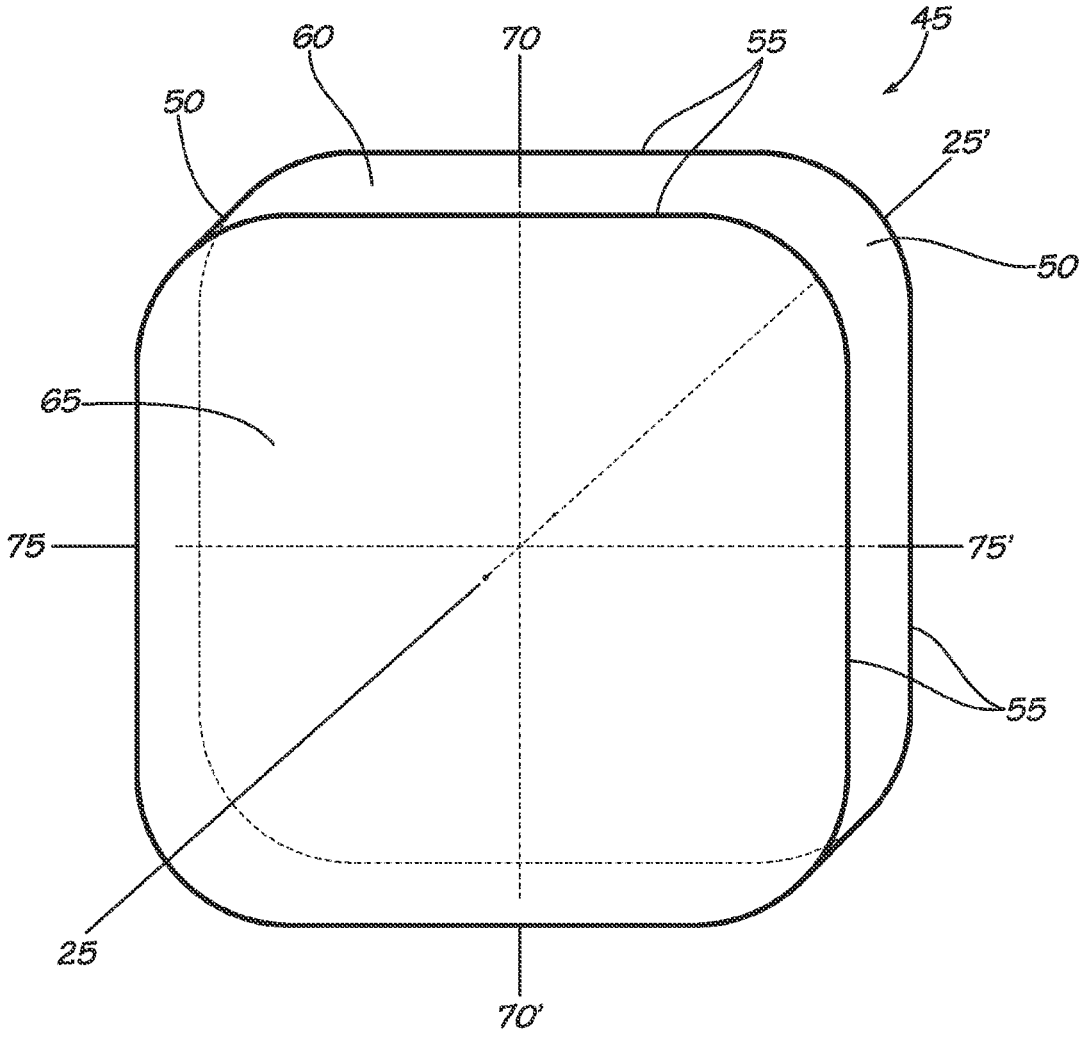
FIG. 4 is a perspective illustration of the general shape of the metal cube rough shot after some rounded edges have been imparted by the drawing die, but prior to grinding for conversion to radiused shot.

FIG. 4 is a perspective view of one example of rough shot after it is cut from the drawn metal wire, but prior to grinding or radiusing by processing in a Steel Ball Processing Machine. Rough shot 45 is approximately cubic because of the equivalent face-to-face or "square profile" diameters (see 40 of FIG. 2) measured from the midpoint of opposing parallel faces 10, that is, the face-to-face distances as measured along the 25-25', the 70-70', and the 75-75' lines are the same. Rough shot 45 features rounded edge imparted by drawing die 50, as well as non-rounded edge imparted by the serial cut 55. Rough shot 45 also features four (4) square faces with two rounded edges imparted by drawing die 60, and two (2) square faces derived from the serial cut with no rounded edges 65, the latter of which has rounded corners imparted by die.

As set out in the metal cube structural features, supra, the size of a square metal wire, based on the face-to-face measurement or "square diameter profile" rather than an edge-to-edge or corner-to-corner diameter profile, can be as much as about 10 mm or even greater. However, the process is typically carried out using wire that corresponds to the conventional birdshot or small buckshot diameters as standard ballistic shot sizes would suggest. For example, when the drawn metal wire has a square or square with rounded edges profile, a common square diameter profile and the length of wire cut with each successive cut, can be from about 1.5 mm to about 5 mm; alternatively, from about 2 mm to about 4.5 mm; alternatively, from about 2.5 mm to about 4 mm; or alternatively, from about 3 mm to about 3.5 mm.

While this aspect has emphasized the drawing method in which metal wire is drawn and then serially cut into rough shot, other methods of forming wire into the desired shape are also useful. For example, metal wire of the selected cross sectional profile can be obtained by the rolling method, in which a precursor metal wire or other metal material is passed through a rolling mill. In this aspect, for example, the shape, size, number, and orientation of the rollers can be selected to impart the desired shape to the rolled wire, which subsequently will be serially cut once it is rolled into a suitable profile. Moreover, if desired, a combination of extruding and rolling methods can be used to alter the cross section of the wire as a combined effect.

b. Radiusing the Rough Shot. Once the rough shot is obtained, the selected radius is placed on the shot to form what is termed the "radiused" shot. Radiused shot differs from finished shot generated in the subsequent step because the radiused shot retains some burrs or flash from the radiusing step. Carry over of these burrs generally renders the radiused shot unsuitable for use as ballistic projectiles until the burrs are removed as disclosed in the subsequent finishing step. Generally, the radiusing step can be carried out by steel ball processing which essentially grinds the cut pellets of rough shot, or by throwing the cut pellets of rough shot against a hardened steel plate at sufficiently high velocities to deform the sharp edges. This latter process is a modification of a conventional abrasive blasting method.

In one aspect, the radiused shot is ground or "radiused" by processing through a Steel Ball Processing Machine, for example, Spezial Maschinenfabrik Schonungen (SMS), model SLM-72. This Steel Ball Processing Machine operates using two, parallel, hardened-steel plates in which the top plate is fixed and the bottom plate is rotating. The fixed top plate includes an opening through which the rough shot is introduced, whereupon the rough shot contacts the rotating bottom plate and is itself moved or tumbled in a circular fashion, while contacting both top and bottom plates. Thus, a monolayer of shot is radiused as it is transported between the plates. After tumbling around a single circular path corresponding to one rotation of the bottom plate, the shot is then ejected from the machine and collected. Thus, a "pass" through a Steel Ball Processing Machine is a single cycle, that is, a single occurrence of processing the shot from its introduction through the top plate to its ejection from the machine, generally corresponding to one rotation of the bottom plate.

One aspect of this disclosure is the selection of the machine parameters such that the rounding process applied during grinding first and foremost operates to radius the non-rounded edge that resulted from the serial cut 55, FIG. 4. When these parameters are established, the rounding process applied during grinding leaves substantially unaltered the rounded edge imparted by drawing die 50. While not intending to be bound by theory, it appears that as the radius of curvature 30*a* that arises from initial grinding of the non-rounded edges 55 approaches the radius of curvature 30*b* of the rounded edges derived from the die 50, the rate at which edges 50 and 55 are further ground or radiused become essentially the same, and a symmetric metal cube with rounded edges is formed. If more radius of curvature is desired, grinding can be continued; however if grinding is continued too long, a round shot will result.

The plate pressure that is brought to bear on the monolayer of shot being radiused is adjustable, e.g., the Spezial Maschinenfabrik Schonungen, model SLM-72 is rated up to 100 kN pressure. However in one aspect, the Steel Ball Processing Machines typically is operated at what is termed a "low machining pressure", that is, sufficiently low that the pressure sensors of the Spezial Maschinenfabrik Schonungen, model SLM-72, do not indicate or register any applied pressure, although the shot is in contact with the top and bottom plates during the pass. In another aspect, the rough shot can be processed through the Steel Ball Processing Machine at a pressure selected so that the shot rolls, but is not adversely deformed during each pass. For example, the process provides that the shot can be radiused using a Steel Ball Processing Machines operated at a pressure of less than 20 kN; alternatively, less than 15 kN; alternatively, less than 12 kN; alternatively, less than 10 kN; alternatively, less than 9 kN; alternatively, less than 8 kN; alternatively, less than 7 kN; alternatively, less than 6 kN; alternatively, less than 5 kN; alternatively, less than 4 kN; alternatively, less than 3 kN; alternatively, less than 2 kN; or alternatively, less than 1 kN. In each of these examples, the lower limit of the pressure is a "low machining pressure" as defined herein. According to another aspect, the process provides that the shot can be radiused using a Steel Ball Processing Machines operated at a low machining pressure.

The number of passes through the Steel Ball Processing Machine that are suitable depend upon a number of factors, including but not limited to: the desired radius to be imparted to the rough shot; the hardness of the shot; the radius of the wire's non-circular cross section imparted by the drawing die as the shot is cut; the revolutions per minute (rpm) of the steel plate; the applied pressure of the plates, if any; and the like. In this aspect, for example, from 1 to about 10 passes is usually sufficient to impart the desired radius, although more passes may be necessary with very hard materials, when placing a greater radius on the shot, and the like. Generally, the more passes that are performed the greater the radius or degree of rounding that is applied to the shot.

Periodic inspection of the shot during grinding can be made to select the appropriate number of passes for the particular metal composition, hardness, and size, or when it is desirable to place a greater radius on the shot, in which case more passes result in a greater applied radius. Once the appropriate number of passes is selected for the given conditions (machining pressure and rpm), in accordance with another aspect, the grinding step can be carried out using ±25% of the equivalent number of revolutions. Alternatively, the grinding step can be carried out using ±20% of the equivalent number of revolutions; ±15% of the equivalent number of revolutions; ±10% of the equivalent number of revolutions; or ±5% of the equivalent number of revolutions as established.

While not intending to be bound by theory, it is believed that one advantage of processing the shot by using a low machining pressure in a Steel Ball Processing Machine is that radiusing is initially applied primarily to the non-radiused edges of the shot derived from the cut, rather than to the edges pre-radiused by the drawing die. With each pass, it is believed that the radius imparted to the non-radiused edges approaches that of the edges pre-radiused by the drawing die, until such time as they are substantially similar, and further radiusing generally is imparted to each edge at essentially the same rate.

According to a further aspect, the grinding step can be carried out using from 1 to 20 passes through a Steel Ball Processing Machine operating at a low machining pressure and at 40-100 rpm. Alternatively, the grinding step can be carried out using from 1 to 15 passes through a Steel Ball Processing Machine operating at a low machining pressure and at 60-100 rpm. Alternatively, the grinding step is carried out using from 1 to 10 passes through a Steel Ball Processing Machine operating at a low machining pressure and at 70-90 rpm.

In other embodiments, the step of applying the radius can be carried out by throwing or launching the cut pellets of rough shot against a hardened steel plate with sufficient velocities to deform the sharp edges thereof. This method is a modification of a conventional abrasive blasting method, because the propelled shot is worked and smoothed in the process, rather than the target as occurs in the conventional process. Depending on the amount of radius desired, the shot can be thrown against the steel plate repeatedly until the selected radius is obtained. Further, the velocity at which the shot is thrown against the steel plate can be adjusted to impart the selected radius with a fewer or greater number repetitions as desired. By this process, the edges can be deformed and a rough radius can be imparted with the desired dimensions. Similar to the steel ball processing method, this process also leaves a sufficient burr that can be removed in the subsequent process.

In some embodiments, the step of throwing the rough shot against a hardened steel plate can be carried out using a wheel designed for abrasive wheel blasting. In a conventional abrasive wheel blasting process, a wheel employs centrifugal force, rather than a propellant gas or liquid, to impel an abrasive shot against an object or part for the purpose of cleaning. In present embodiments, a wheel designed for conventional abrasive wheel blasting can be adapted to throw the rough shot into a hardened steel plate to round the corners, and then return the shot to be thrown again in multiple passes, as desired. The size and speed of the wheel, the number of passes, and other processing parameters, can be adjusted as appreciated by the skilled artisan, to achieve the desired radius and efficiency. The radiused shot so obtained can then be further processed with a finishing medium as described.

c. Centrifugal Disk Finishing of the Radiused Shot. Because the grinding process using the Steel Ball Processing Machine typically leaves a burr or flash on the radiused shot, the radiused shot itself is generally unsuitable as ballistic projectiles without further processing. In one aspect, the removal of the burrs can present the need to balance substantially complete removal of the offending metal, while not significantly adding to the already established radius of curvature. It has been discovered that a subsequent finishing step can be designed to remove the burrs while protecting the established shot structure. In particular, it has been discovered that finishing by a centrifugal disc finishing (CDF) process, using a specifically-tailored finishing media can provide the finished metal cubes with rounded edges.

Once the desired radius is imparted by Steel Ball Processing, the shot can be processed in a centrifugal disc finishing (CDF) machine such as a Rösler Metal Finishing, model FKS 35.1. The Rösler model FKS 35.1 has a large (5.3 cubic feet) usable work bowl volume, although larger or smaller bowls will work well, and the Rösler FKS 35.1 operates at a standard spinner speed of about 145 rpm. It was discovered that the combination of spinner speed; time of CDF processing; finishing medium composition; finishing medium shape, size, cut rate, and finishing effect; and the shot-to-finishing medium weight ratio, all constitute factors that were balanced to provide the desired results. Thus, one aspect of this disclosure includes the design and selection of the finishing medium such that substantially complete removal of the burr is achieved, while not altering the desired radius of curvature. Moreover, it is not necessary that the CDF machine be selected from Rösler Metal Finishing equipment, or that it be the Rösler model FKS 35.1. For example, the Roto-Max® RM-6 centrifugal disk finisher obtained from Hammond Roto-Finish is also useful to effect this portion of the disclosed method.

In one aspect, for example, a ceramic finishing medium that is more aggressive in its the action, having a "fast" or "very fast" cut, works well. Several of the ceramic finishing media manufactured or supplied by Rösler Metal Finishing USA, LLC, can incorporate these features. In another aspect, for example, ceramic finishing media having the combination of a "fast" to "very fast" cut, combined with a "medium" to "course" finish are particularly useful, examples of which include the Rösler RX, RSG, RAH, and RXX designations of ceramic finishing media. According to a further aspect, ceramic finishing media shapes that were discovered to balance the aggressiveness of the cut and the desired finish, manufactured or supplied by Rösler Metal Finishing USA, LLC, including the "S" angle-cut triangle ceramic media. Other useful shapes include the "D" and "F" triangular cut ceramic media, although the useful ceramic media are not limited to these shapes.

One particular ceramic media that was discovered to match the processing requirements for the shape and size of the cubic shot illustrated in Example 1 is the so-called "angle-cut triangle" ceramic material, such as Rösler Metal Finishing, part number RXX/LD 22/10 S-LT. Thus, in one aspect, the finishing medium can consist of, can consist essentially of, or alternatively can comprise, Rösler Metal Finishing ceramic medium number RXX/LD 22/10 S-LT or substantial equivalents thereof. In this aspect, the RXX/LD 22/10 S-LT ceramic material balances the need for substantially complete but not excessive finishing of the shot, with efficient cycle times. This angle cut triangle medium is prism-shaped with three (3) quadrilateral faces and two (2) triangular faces at each end, with the angle between the triangular faces and the quadrilateral faces tilted 30° from normal. This configuration may be referred to herein by either an angle cut triangle or a prism.

According to one feature of the ceramic finishing material, the ceramic medium is prism-shaped, whether triangular or angle cut triangular. In this aspect, the ceramic prism can have a ratio (a:b) of the triangle face height (a) to the largest quadrilateral face length (b) of about 2.0±1.0. The triangle face height (a) is measured from the midpoint of the shortest side to the opposite apex, and the largest quadrilateral face length (b) is measured along the edge of the longest quadrilateral face. In another aspect, the ratio (a:b) of the triangle face height (a) to the largest quadrilateral face length (b) can be about of about 2.0±0.8 or alternatively, about 2.0±0.5. Ceramic finishing media of this structure are relatively aggressive, as illustrated by the ratio (a:b) being selected such that a is greater than b. Thus, the particular Rösler RXX/LD 22/10 S-LT finishing medium that works well has a triangle face height (a) of 22 mm and the largest quadrilateral face height (b) of 10 mm, and a ratio (a:b) of 2.2.

Another, less aggressive ceramic media that was discovered to match the processing requirements for the shape and size of the cubic shot, as illustrated in Example 2, is also an angle-cut triangle ceramic material, such as Rösler Metal Finishing, part number RX 10/10 S. Thus, in one aspect, the finishing medium can consist of, can consist essentially of, or alternatively can comprise, Rösler Metal Finishing ceramic medium number RX 10/10 S. In this aspect, the RX 10/10 S ceramic material also balances the need for substantially complete but not excessive finishing of the shot. This less aggressive finishing medium allows for slightly longer CDF processing times than the more aggressive RXX/LD 22/10 S-LT finishing medium and provides relatively fine control over the final product. According to this aspect, the ceramic prism can have a ratio (a:b) of the triangle face height (a) to the largest quadrilateral face length (b) of about 1±0.3. In another aspect, the ratio (a:b) of the triangle face height (a) to the largest quadrilateral face length (b) can be about of about 1±0.2 or alternatively, about 1±0.1. Ceramic finishing media of this structure are relatively less aggressive and more controlled, as illustrated by the ratio (a:b) being selected such that a is equal to or less than b. Thus, the particular Rösler RX 10/10 S finishing medium that works well in this regard has a triangle face height (a) of 10 mm and the largest quadrilateral face height (b) of 10 mm.

In addition to RXX/LD 22/10 S-LT and RX 10/10 S, other suitable Rösler ceramic media include, but are not limited to, RSG 22/08 S, RSG 30/25 S, RSG 15/18 S, RSG 10/10 F, RSG 13/13 F, RSG 8/8 D, RSG 10/10 D, RX 30/23 S, RX 10/10 D, RX 15/18 S, RX 10/10 F, RX 15/15 F, RXX 10/10 F, RXX 15/15 D, RXX 10/10 D, RXX 6/6 D, RXX 15/18 S, RAH 10/10 D, and RXF 15/18 S. In each case, the designations such as 10/10, 15/18, and the like represent the size a/b (in mm) of the triangle face height (a) as measured from the midpoint of the shortest side to the opposite apex, and the largest quadrilateral face length (b) is measured along the edge of the longest quadrilateral face. This is not intended to be an exhaustive listing, but rather exemplary of those ceramic media having the combination of a cut and finish, while including size and shape parameters that are useful for polygonal shot.

While not intending to be limiting, shape and size features constitute another aspect of suitable ceramic finishing media, which can be quantified by aspect ratio, defined as the ratio of the longer dimension to the shorter dimension of the ceramic finishing media. Generally, suitable ceramic media can have an aspect ratio of from about 1:1 to about 3:1; alternatively, from about 1:1 to about 2.9:1; alternatively, from about 1:1 to about 2.8:1; alternatively, from about 1:1 to about 2.7:1; alternatively, from about 1:1 to about 2.6:1; alternatively, from about 1:1 to about 2.5:1; alternatively, from about 1:1 to about 2.4:1; alternatively, from about 1:1 to about 2.3:1; alternatively, from about 1:1 to about 2.2:1; alternatively, from about 1:1 to about 2.1:1; alternatively, from about 1:1 to about 2.0:1; alternatively, from about 1:1 to about 1.9:1; alternatively, from about 1:1 to about 1.8:1; alternatively, from about 1:1 to about 1.7:1; alternatively, from about 1:1 to about 1.6:1; 1:1 to about 1.5:1; alternatively, from about 1:1 to about 1.4:1; alternatively, from about 1:1 to about 1.3:1; alternatively, from about 1:1 to about 1.2:1; or alternatively, from about 1:1 to about 1.1:1. Generally for the relatively more aggressive ceramic finishing media, the aspect ratios are from about 1:1 to about 2.8:1, from about 1:1 to about 2.6:1; from about 1:1 to about 2.4:1; or from about 1:1 to about 2.2:1. Generally for the relatively less aggressive ceramic finishing media, the aspect ratios are from about 1:1 to about 1.3:1, from about 1:1 to about 1.2:1 or from about 1:1 to about 1.1:1. These ratios seem to achieve the balanced performance for finishing, as described herein.

In one aspect, the CDF process can be carried by mixing shot with a ceramic finishing medium at a variety of shot-to-media ratio. For example, the finishing step can be effected by centrifugal disk finishing using a radiused shot-to-finishing medium weight (wt) ratio of about 1:2 to about 1:3. Alternatively, the finishing step is carried out by centrifugal disk finishing using a radiused shot-to-finishing medium weight (wt) ratio of about 1:2.2 to 1:2.8; alternatively, about 1:2.4 to 1:2.6; or alternatively, about 1:2.5.

A further aspect of the disclosure is the compositions of the ceramic medium that have been discovered to provide the desired finishing performance. While oxides (e.g. alumina, silica, titania, zirconia, and the like) and non-oxides (e.g. carbides, borides, nitrides, silicides, carbon particles and nanoparticles, metal particles and nanoparticles, and the like) can be utilized in the disclosed process, composite ceramic medium that include more than one phase are particularly useful. For example, composites that combine an oxide matrix or continuous phase with at least one abrasive discontinuous phase that imparts or enhances abrasive action, are particularly useful. In this aspect, for example, the matrix phase can comprise or can be selected from an oxide phase, while the abrasive phrase can comprise or can be selected from at least one different oxide phase or at least one non-oxide phase. Also by way of example, a suitable medium can comprise, can consist essentially of, or can consist of alumina, silica, titania, zirconia, ceria, mixed oxides thereof such as silica-alumina, or any combination thereof, as a material used as the matrix (continuous) or the abrasive (discontinuous) phase. Moreover, composites of these recited oxides can be used as continuous or discontinuous phases.

One further aspect is that suitable ceramic finishing media can have a density (at 20° C.) of from about 2.3 g/cm$^3$ to about 3.6 g/cm$^3$. In another aspect, the ceramic finishing media can have a density (at 20° C.) of from about 2.4 g/cm$^3$ to about 3.2 g/cm$^3$; alternatively, from about 2.5 g/cm$^3$ to about 3.0 g/cm$^3$; or alternatively, from about 2.6 g/cm$^3$ to about 2.8 g/cm$^3$.

The radiused shot and the finishing medium can be energetically contacted under conditions sufficient to substantially remove any flash or burr on the radiused shot carried over from the grinding step. For example, in one aspect, the at least 25% of the radiused shot can have burrs that are substantially removed during finishing. Alternatively, at least 50% of the radiused shot can have burrs that are substantially removed during finishing; alternatively least 75% of the radiused shot can have burrs that are substantially removed during finishing.

Generally, the radiused shot and the finishing medium could be energetically contacted at or near the maximum operating speed of the centrifugal disk finishing machine. As the ceramic media are worn down throughout the finishing process, it can be replenished periodically as needed or desired. In this aspect, for example, the ceramic media can be replenished about every 0.5 hours, about every 1 hour, about every 1.5 hours, about every 2 hours, or about every 3 hours, as desired or needed. When replenished, the weight ratio of the initial weight of the radiused shot to the finishing medium used for replenishing can be any ratio desired. For example, the weight ratio of the initial weight of the radiused shot added to the CDF machine to the finishing medium used for replenishing can be about 1:0.5 to about 1:3.7, about 1:1 to about 1:3.4, about 1:2 to about 1:3; alternatively, about 1:2.2 to 1:2.8; alternatively, about 1:2.4 to 1:2.6; or alternatively, about 1:2.5.

In accordance with a further aspect, the finishing step can further energetically contact the radiused shot and the finishing medium as disclosed with a cleaning compound. The cleaning compound can be, for example, the Rösler ZF 113 cleaning compound, or variations or equivalents thereof. However, the use of this cleaning compound is not a required aspect of the disclosed process. Moreover, any cleaning composition that is compatible with the shot composition and the processing equipment and components can be used.

When using the Rösler FKS 35.1 cetrifugal disk finisher (CDF) or equivalents thereof, the CDF is typically operated at a nominal or standard spinner speed of about 145 rpm. When the finishing medium is a ceramic material and the finishing step is carried out by centrifugal disk finishing at a disk speed of 145 rpm, the finishing process can usually take from about 2 to about 20 hours to complete, or about ±25% of the equivalent number of revolutions. In another aspect, when the finishing medium is a ceramic material and the finishing step is carried out by centrifugal disk finishing at a disk speed of 145 rpm, the finishing process can usually take from about 4 to about 16 hours to complete, or about ±20% of the equivalent number of revolutions. These features are typical for low-carbon steel, but they can be adjusted as required for less aggressive finishing when using softer and more mechanically shaped metals, or adjusted as required for more aggressive finishing when using harder and less mechanically shaped metals.

d. Additional Steps. Any number of additional steps can be used at the end of the recited process for further processing or at the beginning of the recited process by which to prepare or provide the desired metal material and/or metal wire. By way of example, and not as a limitation, optional steps can include further processing of the shot, such as annealing and/or polishing the finished non-spherical shot. Also by way of example, and not as a limitation, optional steps can include preceding steps such as forming a suitable metal composition, composite, or alloy by steps that can include mixing, compacting, heating, melting, sintering, and the like, including any combination thereof as the particular composition requires. Optional preceding steps can also include multiple drawing steps to form the desired cross-section of drawn wire.

In one aspect, the finished non-spherical shot can be optionally stress annealed to reduce or eliminate hardening introduced from the mechanical shaping steps, if so desired. For example, useful annealing steps for the low carbon steel shot can be carried out at a temperature from 650 to 850° C., over a time period of 0.5 to 2.5 hours. Alternatively, for example, the annealing steps for the low carbon steel shot can be carried out at a temperature from 680 to 815° C., over a time period of about 1 hour.

If desired, the finished non-spherical shot or the annealed finished non-spherical shot optionally can be polishing, if desired. The polishing process is not limited to a particular type of machine or process, and does not require a specific polishing agent or compound. For example, the polishing step can be carried out using a vibrating bowl finishing method in which polishing is effected using part-on-part contact and can be carried out from about 5 minutes to about 60 minutes. Alternatively, for example, the polishing step is carried out using a vibrating bowl finishing machine from about 10 to about 30 minutes. In these examples, it is usually advantageous and sufficient that part-on-part contact provide the means for finishing. Thus, it is not necessary to employ a separate polishing component.

Wire and Shot Composition

According to one aspect, the disclosed method is amenable for use with any materials that can be mechanically shaped, examples of which include low-carbon steel, copper, alloys of copper, and other alloys and composite as provided herein. For example, the metal wire that can be used in the disclosed process can be selected from, or alternatively can comprise, steel, iron, tungsten, copper, bismuth, zinc, tin, lead, antimony, aluminum, molybdenum, nickel, chromium, any combination thereof, any composite thereof, or any alloy thereof. The term "any composite thereof" is intended to include composites that comprise any of the recited metals or comprise any alloy of the recited metals, including composites that include metal or alloy phases that are not among those recited herein. The term "any alloy thereof" is intended to include alloys that comprise any of the recited metals in combination with any other metal, regardless of whether the other metal is specifically recited herein. This disclosure also includes non-alloyed metals, such as pure copper, which is suitable for use by the disclosed method. As long as the metal can be mechanically shaped, it is suitable for use as wire and shot according to this disclosure.

In one aspect, and by way of example, the metal wire and shot can have less than or equal to 0.30 weight (wt) % carbon, less than or equal to 1.65 weight % manganese, less than or equal to 0.60 weight % silicon, less than or equal to 0.60 weight copper, or any combination of these composition parameters. In another example, the metal wire and shot of this disclosure can have less than about 0.20 weight % carbon. For example, one suitable metal wire is a steel wire having a carbon content of less than 0.08 weight %, a manganese content of 0.25-0.40 weight %, a phosphorus content of less than 0.04 weight %, and a sulfur content of less than 0.05 weight %. Again, these exemplary compositions are not intended to be limiting, but rather illustrative of the many compositions that can be used.

A further aspect of this disclosure provides for using an iron-based alloy metal wire and shot that can contain, for example 0.03-0.15 weight % carbon, and preferably 0.04-0.08% carbon; or less than 0.2% carbon; alternatively, less than 0.15% carbon; alternatively, less than 0.1% carbon; alternatively, less than 0.08% carbon; or alternatively, less than 0.05% carbon. Therefore, mild steel wire material can be used as a raw material for the wire and shot according to the present disclosure because this low carbon steel is more suitable for the required mechanical deformation. In another aspect, the iron-based alloy may contain 0.10-0.40% aluminum (Al), preferably 0.20-0.32% aluminum by weight ratio. An addition of aluminum (Al) can suppress age-hardening after producing the shot. Further, the iron-based alloy can contain 0.01-0.04% silicon (Si). Moreover, the iron-based alloy can contain 0.10-0.40% manganese (Mn). The iron-based alloy also can contain 0.005-0.030% phosphorus (P) and/or 0.010-0.030% sulfur (S).

One feature of this process is the substantial range of carbon steels that can be used according to the disclosed methods. While not intending to be limiting, and by way of further describing the process, the following steels are appropriate for preparing the disclosed metal cubes or polygons.

a) Carbon steel SAE 1005 or a similar steel is suitable. For example, a steel having less than or equal to 0.06 weight % carbon, less than or equal to 0.35 weight % manganese, less than or equal to 0.04 weight % phosphorus, and less than or equal to 0.05 weight % sulfur works well in the disclosed process.

b) Carbon steel SAE 1006 or a similar steel is suitable. For example, a steel having less than or equal to 0.08 weight % carbon, less than or equal to 0.35 weight % manganese, less than or equal to 0.04 weight % phosphorus, and less than or equal to 0.05 weight % sulfur works well in the disclosed process.

c) Carbon steel SAE 1010 or a similar steel is also suitable. For example, a steel having less than or equal to 0.10 weight % carbon, less than or equal to 0.45 weight % manganese, less than or equal to 0.04 weight % phosphorus, and less than or equal to 0.05 weight % sulfur is also appropriate for use in the current process.

d) Carbon steel SAE 1013 or a similar steel is also suitable. For example, a steel having less than or equal to 0.16 weight % carbon, less than or equal to 0.80 weight % manganese, less than or equal to 0.04 weight % phosphorus, and less than or equal to 0.05 weight % sulfur is also appropriate for use in the current process.

e) Carbon steel SAE 1015 or a similar steel is also suitable. For example, a steel having less than or equal to 0.18 weight % carbon, less than or equal to 0.60 weight % manganese, less than or equal to 0.04 weight % phosphorus, and less than or equal to 0.05 weight % sulfur is also appropriate for use in the current process.

f) In another aspect, carbon steel SAE 1020 or a similar steel is useful in the method provided herein. For example, a steel having less than or equal to 0.20 weight % carbon, less than or equal to 0.45 weight % manganese, less than or equal to 0.04 weight % phosphorus, and less than or equal to 0.05 weight % sulfur is also useful in the disclosed methods.

By way of example and not as a limitation, the compositions of some specific carbon steel grades that are suitable for use according to this disclosure are provided in Table 2.

TABLE 2

Selected Carbon Steel Chemical Compositions (ASTM A29 and SAE J403)

| AISI/SAE grade | Carbon (C) wt % | Manganese (Mn) wt % | Phosphorus (P) max wt % | Sulfur (S) max wt % |
|---|---|---|---|---|
| 1005/1005 | 0.06 max | 0.35 max | 0.04 | 0.05 |
| 1006/1006 | 0.08 max | 0.35 max | 0.04 | 0.05 |
| 1008/1008 | 0.10 max | 1.30-0-50 | 0.04 | 0.05 |
| 1010/1010 | 0.08-0.13 | 0.30-0.60 | 0.04 | 0.05 |
| 1011/— | 0.08-0.13 | 0.60-0.90 | 0.04 | 0.05 |
| 1012/1012 | 0.10-0.15 | 0.30-0.60 | 0.04 | 0.05 |
| 1013/1013 | 0.11-0.16 | 0.50-0.80 | 0.04 | 0.05 |
| 1015/1015 | 0.13-0.18 | 0.30-0.60 | 0.04 | 0.05 |
| 1016/1016 | 0.13-0.18 | 0.60-0.90 | 0.04 | 0.05 |
| 1017/1017 | 0.15-0.20 | 0.30-0.60 | 0.04 | 0.05 |
| 1018/1018 | 0.15-0.20 | 0.60-0.90 | 0.04 | 0.05 |
| 1019/1019 | 0.15-0.20 | 0.70-1.00 | 0.04 | 0.05 |
| 1020/1020 | 0.17-0.23 | 0.30-0.60 | 0.04 | 0.05 |
| M1020/— | 0.17-0.24 | 0.25-0.60 | 0.04 | 0.05 |
| 1021/1021 | 0.18-0.25 | 0.60-0.90 | 0.04 | 0.05 |
| 1022/1022 | 0.18-0.23 | 0.70-1.00 | 0.04 | 0.05 |
| 1023/1023 | 0.20-0.25 | 0.30-0.60 | 0.04 | 0.05 |
| 1025/1025 | 0.22-0.28 | 0.30-0.60 | 0.04 | 0.05 |
| 1026/1026 | 0.22-0.28 | 0.60-0.90 | 0.04 | 0.05 |
| 1029/— | 0.25-0.31 | 0.60-0.90 | 0.04 | 0.05 |
| 1030/1030 | 0.27-0.34 | 0.60-0.90 | 0.04 | 0.05 |

While not intending to be limiting, and by way of further describing suitable materials for the disclosed process, the lead-free materials that are disclosed in the following references and that can be mechanically shaped are useful in the method described herein: U.S. Pat. or Patent Application Publication Numbers: U.S. Pat. No. 6,749,662 (Bueneman et al.); U.S. Pat. No. 6,258,316 (Bueneman et al.); U.S. Pat. No. 7,232,473 (Elliott); U.S. Pat. No. 7,217,389 (Amick); U.S. Pat. No. 6,981,996 (Shaner et al.); U.S. Pat. No. 6,823,798 (Amick); U.S. Pat. No. 6,815,066 (Elliott); U.S. Pat. No. 6,749,802 (Amick); U.S. Pat. No. 6,551,375 (Siddle et al.); U.S. Pat. No. 6,536,352 (Nadkarni et al.); U.S. Pat. No. 6,527,824 (Amick); U.S. Pat. No. 6,447,715 (Amick); U.S. Pat. No. 6,394,881 (Watanabe et al.); U.S. Pat. No. 6,248,150 (Amick); U.S. Pat. No. 6,174,494 (Lowden et al.); U.S. Pat. No. 6,158,351 (Mravic et al.); U.S. Pat. No. 6,149,705 (Lowden et al.); U.S. Pat. No. 5,913,256 (Lowden et al.); U.S. Pat. No. 5,877,437 (Oltrogge); U.S. Pat. No. 5,814,759 (Mravic et al.); U.S. Pat. No. 5,760,331 (Lowden et al.); U.S. Pat. No. 5,602, 350 (German et al.); U.S. Pat. No. 5,527,376 (Amick et al.); U.S. Pat. No. 5,399,187 (Mravic et al.); U.S. Pat. No. 5,279,787(Oltrogge); U.S. Pat. No. 5,189,252 (Huffman et al.); U.S. Pat. No. 5,088,415 (Huffman et al.); and 2004/0211292 (Bueneman et al.). Each of these references is incorporated herein by reference in pertinent part.

Use of Metal Cubes with Rounded Edges in Shotshells

The metal cubes with rounded-edges prepared according to this disclosure have a smoothed hexahedral shape that packs more efficiently and compactly into the shotshell hull, thereby allowing greater shot payloads as compared to spherical shot in the same sized hull. For example, conventional spherical steel waterfowl loads in a 12 gauge, 3-inch shotshell launch 1⅛ ounces of conventional spherical steel shot, as compared to 1⅜ ounces of metal cubes with rounded-edges in the same 12 gauge, 3-inch hull. From a 12 gauge, 3½-inch shotshell, 1⅜ ounces of conventional spherical steel shot is the typical payload, as compared to 1⅝ ounces of metal cubes with rounded-edges in the same 12 gauge, 3½-inch hull.

This ability to load more shot weight in the same unit volume is particularly applicable for improved hunting loads, where ballistic steel and various alloys of tungsten, iron, bismuth and the like are supplanting lead shot, as lead becomes more strictly regulated. While it is possible to achieve the general geometry of the metal cubes with rounded edges by other processes, these other processes are not amenable for mass production of cubes in the desired size range, which is typically about 5 mm or smaller, nor are they sufficiently economically viable.

Definitions and General Disclosure

Unless otherwise indicated, the following definitions are applicable to this disclosure. If a term is used in this disclosure but is not specifically defined herein, the definition from the Academic Press Dictionary of Science and Technology (c. 1992, Academic Press, Inc., San Diego, Calif., ISBN 0-12-200400-0) can be applied, as long as that definition does not conflict with any other disclosure or definition applied herein, or render indefinite or non-enabled any claim to which that definition is applied. To the extent that any definition or usage provided by any document incorporated by reference conflicts with the definition or usage provided herein, the definition or usage provided herein controls. Thus, in this specification and in the claims that follow, reference will be made to a number of terms, which shall be defined to have the following meanings:

"Optional" or "optionally" means that the subsequently described event or circumstance can or cannot occur, and that the description includes instances where the event or circumstance occurs and instances where it does not.

By the terms "essentially" or "substantially", or other forms of the word such as "substantial", it is meant a deviation from the stated value of less than 10%, less than 5%, or less than 2%.

The term "sphere" is intended to reflect an idealized structure that is "sphere-like" or spheroidal, and anticipates that some particles will be out-of-round and somewhat irregular in shape.

A weight percent of a component, unless specifically stated to the contrary, is based on the total weight of the formulation or composition in which the component is included.

When values are expressed as approximations, by use of the antecedent "about," it will be understood that the particular recited value forms another embodiment. It is also understood that when a particular value is disclosed, "about" that particular value in addition to the value itself. For example, if the value "10" is disclosed, then "about 10" is also disclosed.

Unless indicated otherwise, when a range of any type is disclosed or claimed, for example a range of weight percentages, processing times, and the like, it is intended that the stated range disclose or claim individually each possible number that such a range could reasonably encompass, including any sub-ranges and combinations of sub-ranges encompassed therein. For example, when describing a range of measurements such as weight percentages, every possible number that such a range could reasonably encompass can, for example, refer to values within the range with one significant digit more than is present in the end points of a range. In this example, a weight percentage between 10 percent and 20 percent includes individually 10, 11, 12, 13, 14, 15, 16, 17, 18, 19, and 20 weight percent. Applicant's intent is that these two methods of describing the range are interchangeable. Moreover, when a range of values is disclosed or claimed, which Applicants intent to reflect individually each possible number that such a range could reasonably encompass, Applicants also intend for the disclosure of a range to reflect, and be interchangeable with, disclosing any and all sub-ranges and combinations of sub-ranges encompassed therein. Accordingly, Applicants reserve the right to proviso out or exclude any individual members of any such group, including any sub-ranges or combinations of sub-ranges within the group, if for any reason Applicants choose to claim less than the full measure of the disclosure, for example, to account for a reference that Applicants are unaware of at the time of the filing of the application.

In any application before the United States Patent and Trademark Office, the Abstract of this application is provided for the purpose of satisfying the requirements of 37 C.F.R. §1.72 and the purpose stated in 37 C.F.R. §1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

The present disclosure is further illustrated by the following examples, which are not to be construed in any way as imposing limitations upon the scope thereof. The examples are set forth to illustrate the disclosed subject matter and are not intended to be inclusive of all aspects of the subject matter disclosed herein, but rather to illustrate representative methods and results. These examples do not intended to exclude equivalents and variations of the present invention which are apparent to one skilled in the art.

EXAMPLES

Unless indicated otherwise, parts are parts by weight, temperature is at ambient temperature, and pressure is at or near atmospheric.

Example 1

Preparation of Approximately Cubic Shot with Rounded Edges

Steel wire (SAE 1006) was drawn into a square profile with rounded edges, in which the square profile diameter was from 2.5 mm to 3.5 mm, having rounded edges corresponding to the desired radius of from 0.8 mm to 1.5 mm, FIG. 2. The square wire was then chopped into approximate cubes using a rotating head shearer with carbide blocks The cubes were then ground by processing through a Steel Ball Processing Machine, Spezial Maschinenfabrik Schonungen, model SLM-72. This grinding step was carried out using from 5 to 10 passes through a Steel Ball Processing Machine operating at a low machining pressure (no pressure sensor reading) and at 80 rpm. Periodic inspection of the shot during grinding was made to adjust the appropriate number of passes, if more rounding was needed or desired.

Once the desired radius was imparted to the shot, the radi-used shot was processed in a centrifugal disc finishing (CDF) machine, Rösler Metal Finishing, model FKS 35.1. The radi-used shot was combining the shot with a ceramic media, at a 1:2.5 shot-to-media ratio by weight. The particular ceramic media selected was an angle-cut triangle, Rösler Metal Finishing, part number RXX/LD 22/10 S-LT. The cleaning compound used in the CDF process along with the ceramic medium was Rösler, part number ZF 113, which functioned as a universal cleaning compound and provided some corrosion protection. The shot was run at an operating speed of about 145 rpm, for a cycle time of about 8 to about 10 hours. As the ceramic media was worn down, it was periodically replenished, which occurred about every hour.

The resulting hexahedral or cubic shot was then annealed at between about 750° C. for about 1 hour in a rotary furnace to remove the work-hardening that occurred during processing. Lastly, the shot was placed in a vibrating bowl finishing machine while still hot for about 20 minutes to provide a fine polish to the shot surfaces.

Example 2

Preparation of Approximately Cubic Shot with Rounded Edges

Steel wire (SAE 1006) was drawn into a square profile with rounded edges, in which the square profile diameter was from 2.5 mm to 3.5 mm, having rounded edges corresponding to the desired radius of from 0.8 mm to 1.5 mm, FIG. 2. The square wire was then chopped into approximate cubes using a rotating head shearer with carbide blocks The cubes were then ground by processing through a Steel Ball Processing Machine, Spezial Maschinenfabrik Schonungen, model SLM-72. This grinding step was carried out using from 5 to 10 passes through a Steel Ball Processing Machine operating at a low machining pressure (no pressure sensor reading) and at 80 rpm. Periodic inspection of the shot during grinding was made to adjust the appropriate number of passes, if more rounding was needed or desired.

Once the desired radius was imparted to the shot, the radi-used shot was processed in a centrifugal disc finishing (CDF) machine, Rösler Metal Finishing, model FKS 35.1. The radi-used shot was combining the shot with a ceramic media, at a 1:2.5 shot-to-media ratio by weight. The particular ceramic media selected was an angle-cut triangle, Rösler Metal Finishing, part number RX 10/10 S. The cleaning compound used in the CDF process along with the ceramic medium was Rösler, part number ZF 113, which functioned as a universal cleaning compound and provided some corrosion protection. The shot was run at an operating speed of about 145 rpm, for a cycle time of about 8 to about 12 hours. As the ceramic media was worn down, it was periodically replenished, which occurred about every hour.

The resulting hexahedral or cubic shot was then annealed at between about 750° C. for about 1 hour in a rotary furnace to remove the work-hardening that occurred during processing. Lastly, the shot was placed in a vibrating bowl finishing machine while still hot for about 20 minutes to provide a fine polish to the shot surfaces.

Example 3

Constructive Preparation of Additional Sizes of Cubic Shot with Rounded Edges

Using the general method detailed in Examples 1 or 2, steel or other alloy wire can be drawn into a square profile with rounded edges, in which the wire can have a square profile diameter of about 1 mm, about 1.5 mm, about 2 mm, about 2.5 mm, about 3 mm, about 3.5 mm, about 4 mm, about 4.5 mm, about 5 mm, about 5.5 mm, or about 6 mm. The die or drawing plate used can have any desired radius to transfer to the drawn or extruded wire, for example, the radius of curvature (x)-to-metal wire square profile diameter (y) ratio x:y can be from 1:1 to 1:5; alternatively, from 1:1.5 to 1:4.5; alternatively, from 1:2 to 1:4; or alternatively, from 1:2.5 to 1:3.5.

The resulting cubes can then be ground by processing through a Steel Ball Processing Machine, Spezial Maschinenfabrik Schonungen, model SLM-72, at a pressure selected so that the shot rolls but is not adversely deformed, for 1 to 10 passes depending on desired radius. The shot can then be processed in a centrifugal disc finishing (CDF) machine, Rösler Metal Finishing, model FKS 35.1, by mixing the shot with a ceramic media at a shot-to-media weight ratio of about 1:2.2 to 1:2.8; alternatively, about 1:2.4 to 1:2.6; or alternatively, about 1:2.5 and processing according to Examples 1 or 2. For example, the particular ceramic media selected can be an angle-cut triangle such as Rösler Metal Finishing, part numbers RX 10/10 S, RSG 22/08 S, RSG 30/25 S, RSG 15/18 S, RX 30/23 S, RX 15/18 S, RXX 15/18 S, RXF 15/18 S, or combinations thereof. The particular ceramic media can also be selected from a triangle such as Rösler Metal Finishing, part numbers RSG 10/10 F, RSG 13/13 F, RX 10/10 F, RX 15/15 F, RXX 10/10 F, RSG 8/8 D, RSG 10/10 D, RX 10/10 D, RXX 15/15 D, RXX 10/10 D, RXX 6/6 D, RAH 10/10 D, or combinations thereof. If desired, the CDF process can be carried out in the presence of a cleaning compound, for example, Rösler, part number ZF 113.

Example 4

Constructive Example of Annealing and Polishing the Cubic Shot with Rounded Edges Following finishing the metal shot as disclosed herein, the cubic shot prepared according to Examples 1 through 3, can be annealed in a rotary furnace to remove the work-hardening that occurred during processing. For example, useful annealing steps for the low carbon steel shot is carried out at a temperature from 650 to 850° C., over a time period of 0.5 to 2.5 hours, or at a temperature from 680 to 815° C., over a time period of about 1 hour.

Following finishing and/or annealing of the metal shot, the shot can be placed in a vibrating bowl finishing machine to provide a fine polish to the shot surfaces. For example, the polishing step is carried out using a the vibrating bowl finishing method in which polishing is carried out from about 5 minutes to about 60 minutes. Alternatively, the polishing step is carried out using a vibrating bowl finishing machine from about 10 to about 30 minutes.

It will be apparent to those skilled in the art that various modifications and variations can be made in the present disclosure and examples without departing from the scope or spirit of the invention. Other embodiments of the invention will be apparent to those skilled in the art from consideration of the specification and practice of the invention disclosed herein.

What is claimed is:

1. A process for making metal cubic pellets with rounded edges, the process comprising:

a. providing a metal wire having a cross section that is square or square with rounded corners;

b. serially cutting the metal wire into rough cubes;

c. applying a radius to the rough cubes to provide radiused cubes with edges having a selected radius of curvature, the radiused cubes having a burr or flash; and d. finishing the radiused cubes by energetically contacting the radiused cubes with a finishing medium to remove the burr or flash and provide finished metal cubic pellets with rounded edges.

2. A process according to claim 1, wherein the step of applying a radius to the rough cubes is carried out by grinding or by modified abrasive blasting.

3. A process according to claim 1, wherein the step of applying a radius to the rough cubes is carried out by grinding using a Steel Ball Processing Machine.

4. A process according to claim 1, wherein the step of applying a radius to the rough cubes is carried out by grinding using a Steel Ball Processing Machine operating at a low machining pressure.

5. A process according to claim 1, wherein the finishing step is carried out by centrifugal disk finishing.

6. A process according to claim 1, wherein the finishing medium is selected from a ceramic material.

7. A process according to claim 1, wherein the finishing medium is a Rösler Metal Finishing ceramic medium selected from an RX, RSG, RAH, and RXX medium, or any combination thereof.

8. A process according to claim 1, wherein the finishing step further energetically contacts the radiused cubes and the finishing medium with a cleaning compound.

9. A process according to claim 1, wherein the metal wire is extruded or drawn through a die having a cross section that is square or square with rounded corners.

10. A process according to claim 1, wherein the metal wire has a 1 mm to 5mm square cross section.

11. A process according to claim 1, further comprising the step of annealing the finished metal cubic pellets.

12. A process according to claim 11, further comprising the step of polishing the annealed finished metal cubic pellets.

13. A process according to claim 12, wherein the polishing step is carried out using a vibrating bowl finishing machine.

14. A process according to claim 1, wherein the metal wire comprises steel.

15. A process for making metal cubic pellets with rounded edges, the process comprising:

a. providing a metal wire having a cross section that is square or square with rounded corners;

b. serially cutting the metal wire into rough cubes;

c. grinding the rough cubes to provide radiused cubes with edges having a selected radius of curvature, the radiused cubes having a burr or flash; and d. finishing the radiused cubes by energetically contacting the radiused cubes and a finishing medium by centrifugal disk finishing to remove the burr or flash and provide finished metal cubic pellets with rounded edges.

16. A process according to claim 15, wherein the grinding step is carried out using a Steel Ball Processing Machine.

17. A process according to claim 15, wherein the grinding step is carried out using a Steel Ball Processing Machine operating at a low machining pressure.

18. A process according to claim 15, wherein the finishing medium is selected from a ceramic material.

19. A process according to claim 15, wherein the finishing medium is a Rösler Metal Finishing ceramic medium selected from an RX, RSG, RAH, and RXX medium, or any combination thereof.

20. A process according to claim 15, further comprising annealing the finished metal cubic pellets.

21. A process according to claim 20, further comprising polishing the annealed finished metal cubic pellets.

22. A process according to claim 15, wherein the metal wire comprises steel.

23. A process according to claim 15, wherein the metal wire is extruded or drawn through a die having a cross section that is square or square with rounded corners.

24. A process according to claim 15, wherein the metal wire has a 1 mm to 5 mm square cross section.

* * * * *